US006161310A

United States Patent [19]

Tuggle et al.

[11] Patent Number: 6,161,310

[45] Date of Patent: Dec. 19, 2000

[54] DRYER VENT ELBOW AND METHOD OF ASSEMBLY

[75] Inventors: W. Gregory Tuggle; Robert Kenrick, both of Spring Lake, Mich.

[73] Assignee: Builder's Best, Inc., Jacksonville, Tex.

[21] Appl. No.: 09/266,216

[22] Filed: Mar. 10, 1999

Related U.S. Application Data

[60] Provisional application No. 60/078,483, Mar. 18, 1998.

[51] Int. Cl.[7] ..... F26B 3/00

[52] U.S. Cl. ..... 34/480; 34/140; 34/233; 34/235

[58] Field of Search ..... 34/82, 606, 134, 34/140, 231, 232, 233, 235; 454/339, 361, 254, 271; 285/144.1, 147.1, 181

[56] References Cited

U.S. PATENT DOCUMENTS

| | | | |
|---|---|---|---|
| D. 342,130 | 12/1993 | Anderson et al. | D23/393 |
| D. 412,030 | 7/1999 | Tuggle | D23/393 |
| 5,145,217 | 9/1992 | Anderson et al. | 285/179 |
| 5,645,482 | 7/1997 | Moss et al. | 454/339 |
| 5,653,631 | 8/1997 | Anderson et al. | 454/339 |
| 5,970,623 | 10/1999 | Tuggle | 34/134 |

*Primary Examiner*—Pamela A. Wilson

*Attorney, Agent, or Firm*—Rader Fishman Grauer & McGarry an office of Rader Fishman & Grauer, PLLC

[57] ABSTRACT

An elbow for use in connecting the exhaust vent of a clothes dryer to an exhaust duct. The elbow having a depth equal to or less than the exhaust duct diameter while maintaining a constant exhaust airflow velocity. Preferably, the elbow comprises a rectangular portion connected to the dryer exhaust vent and an adapter portion extending from the rectangular portion and connecting to the exhaust duct.

31 Claims, 7 Drawing Sheets

DRYER VENT ELBOW AND METHOD OF ASSEMBLY

CROSS-REFERENCE TO RELATED APPLICATIONS

This application claims the benefit of U.S. Provisional Application Serial No. 60/078,483, filed Mar. 18, 1998.

BACKGROUND OF THE INVENTION

1. Field of the Invention

The invention is related to a dryer vent elbow, and, more specifically, to a short depth dryer vent elbow and its method of construction.

2. Description of the Related Art

In most contemporary residential clothes dryer installations, the clothes dryer has a dryer exhaust vent connected to an exhaust duct, extending from the clothes dryer to the exterior of the house to vent the dryer exhaust air outside. Typically, the dryer exhaust vent is horizontally oriented and the exhaust duct is vertically oriented. A dryer vent elbow is positioned between the exit of the dryer exhaust vent and the entrance of the exhaust duct. The elbow aids in making the right angle connection between the horizontally oriented dryer exhaust vent and the vertically oriented exhaust duct.

Dryer vent elbows are usually made from aluminum and can comprise multiple segments. The multiple segments can be fixed relative to one another or rotate relative to one another in an articulated elbow. Dryer elbows typically have a circular cross-section with a diameter that conforms to the dryer exhaust vent diameter and the exhaust duct diameter. It is desirable to maintain a constant cross-sectional area to maintain a constant velocity for the exhaust air, which tends to prevent lint and other material entrained in the exhaust air from falling out of the air flow until the air is expelled from the exhaust duct into the atmosphere.

A consequence of making the elbow with a circular cross-section and a constant diameter is that the elbow has a depth greater than the diameter of the dryer exhaust vent. Often, the depth of the elbow is substantially greater than the diameter of the dryer exhaust vent and the exhaust duct. An unfortunate result of this configuration is that the dryer, which is typically placed with its back up against a wall, must be spaced from the wall to accommodate the depth of the elbow. Excess spacing of the dryer from the wall is undesirable in that valuable room space is lost. Additionally, many users consider the spacing of the dryer from the wall aesthetically unpleasing.

SUMMARY OF THE INVENTION

The invention is a dryer vent elbow for connecting a dryer exhaust vent to an exhaust duct to control the flow path of dryer exhaust air from a clothes dryer. The dryer vent elbow comprises an inlet adapted to connect to the dryer exhaust vent and an outlet adapted to connect to the exhaust duct. The inlet and outlet connect to a body. The body comprises an inlet opening, connected to the inlet, and an outlet opening, connected to the outlet. The body includes a front having a lower portion with the inlet opening and an upper portion with an upper edge that partially defines the outlet opening. The body also includes a back connected to the front and having a lower portion partially defining a rectangular cross section. The back also has an upper portion with a partial circular cross section having an upper edge that partially defines the outlet opening. The body has a generally rectangular cross section defined by the front and back lower portions that transitions to a generally circular cross section defined by the front and back upper edges to form the outlet opening. The distance from the inlet to the back wall is equal to or less than the exhaust duct diameter.

Preferably, the cross-sectional area within the body in any plane normal to the path flow is generally constant. The body can taper from the lower portion to the upper edge. The back lower portion can include a deflector comprising an angled wall extending upwardly away from the front lower portion and adapted to deflect dry exhaust air from the inlet opening to the outlet opening.

The front and back are preferably connected together by overlapping corresponding tabs on the front and back. The corresponding tabs can be folded over a second time about a common fold line to lock together the-front and back.

Another aspect of the invention is a method for manufacturing a dryer vent elbow comprising a body with an inlet and an outlet, with the body including a front and a back. The method includes forming the back from a blank with an arcuate end that forms the upper edge of the rear and forming the front from a blank with an opening and an upper edge. The front and back blanks are then connected to assemble the body with the front blank opening forming the inlet opening and the arcuate end and upper edge forming the outlet opening. An inlet and an outlet are provided and connected to the inlet and outlet openings, respectively.

Preferably, the edges of the front and back blanks are bent to form complementary tabs which are bent over to connect the front blank to the back blank. The complementary tabs can be bent a second time about a common bin line to lock the front and back blanks together.

BRIEF DESCRIPTION OF THE DRAWINGS

The invention will now be described with reference to the drawings in which.

DETAILED DESCRIPTION OF THE PREFERRED EMBODIMENTS

Figure 1:
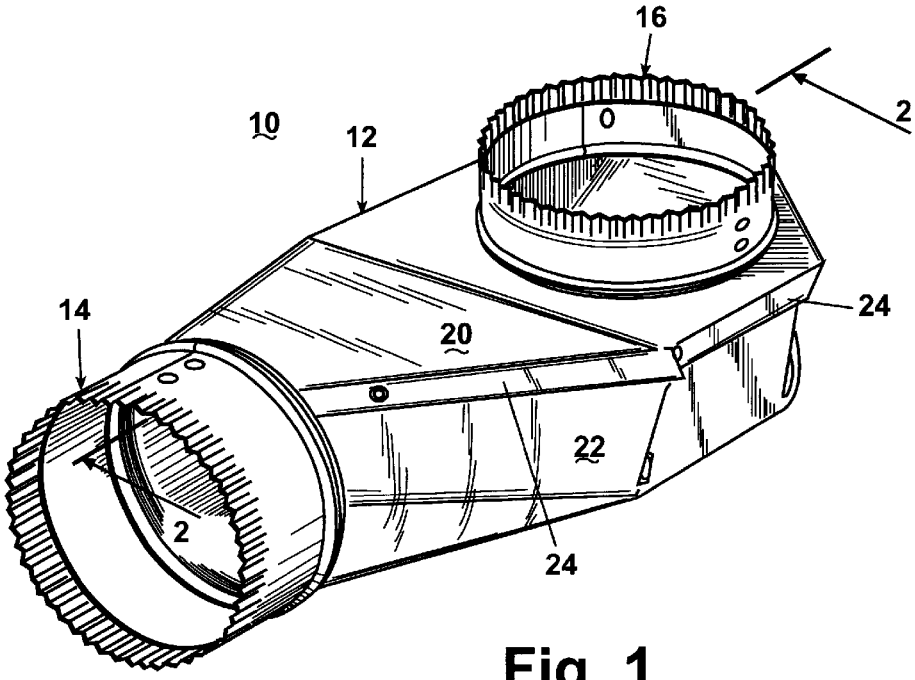
FIG. 1 is a perspective view of a dryer vent elbow according to the invention.
Figure 2:
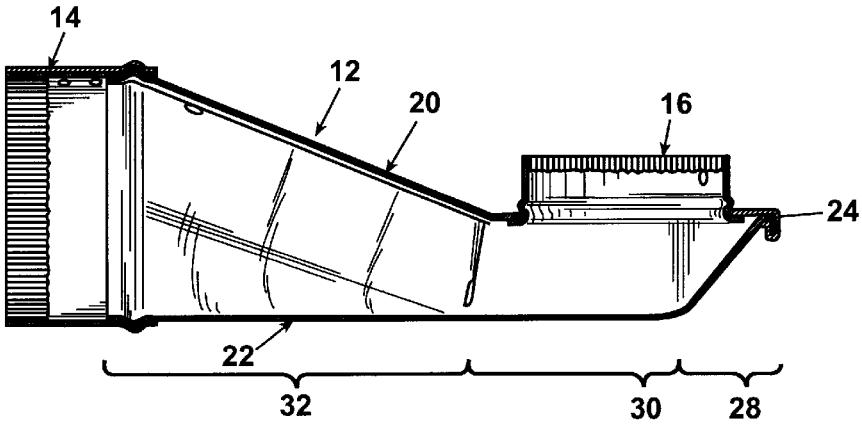
FIG. 2 is a longitudinal sectional view taken along line 2—2 of FIG. 1.
Figure 3:
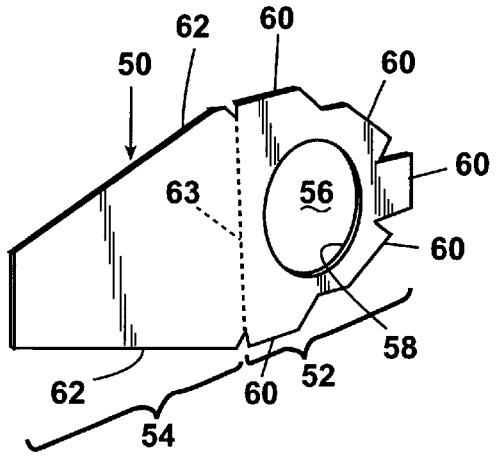
FIG. 3 is a perspective view of a blank for the front of the elbow of FIG. 1.

FIGS. 1, 2 and 3 illustrate a dryer vent elbow 10 according to the invention for connecting a dryer exhaust vent 80 to an exhaust duct 82 to control the flow path A of the dryer exhaust air, exiting the dryer 84. The elbow 10 comprises a body 12 on which are provided an outlet portion 14 and an inlet portion 16. Preferably, the outlet portion is a collar fixedly mounted to the exit end of the body 12. The inlet portion 16 is preferably a collar rotatably mounted to the body 12. The ends of the outlet portion 14 and inlet portion 16 preferably have a crimped peripheral edge to physically reduce their outer diameters and permit easy insertion of the outlet portion 14 into the exhaust duct and the inlet portion 16 into the dryer vent exhaust. Neither the inlet nor outlet must be crimped. It is within the scope of the invention for the inlet and outlet to be received over the dryer exhaust vent and exhaust duct, respectively. In such instance, the inlet fits over the dryer exhaust vent and the outlet is received within the exhaust duct to reduce any edges against which lint in the airflow can be trapped. It is also within the scope of the invention for the outlet portion to be rotatably mounted and the inlet portion can be fixedly mounted.

The body 12 comprises a front 20 and a rear 22, which are connected by a series of interlocking tabs 24 and mechanical fasteners, such as rivets, where needed. Conceptually, the body 12 can be divided into three areas: a deflector portion 28, rectangular portion 30, and transition portion 32. The deflector portion 24 deflects the incoming airflow from the dryer exhaust vent entering the elbow 10 through the inlet 16 upwardly toward the rectangular portion 30. The rectangular portion provides a reduced depth for a given cross-sectional area as compared to prior art circular cross sections. The transition portion changes the cross-sectional shape from rectangular to circular, permitting the outlet 14 to be connected to a standard circular exhaust duct. The deflector portion 28, rectangular portion 30, and transition portion 32 are shaped to provide a generally constant cross-sectional area to maintain a generally constant airflow.

The front 20 and rear 22 will be described in greater detail in the context of their manufacture and assembly. Referring to FIG. 3, the front 20 is formed from a front stamping blank 50 having a somewhat rounded portion 52 and a tapered portion 54. The rounded portion has an opening 56 defined by a circumferential edge 58. Tabs 60 extend about the perimeter of the rounded portion 52. Tabs 62 extend along the sides of the tapered portion 54. The junction of the tabs 60 and the tabs 62 define a conceptual separating line 63 between the rounded portion 52 and the tapered potion 54. Tabs 60 and 62 form one portion of the interlocking tabs 24.

Figure 4:
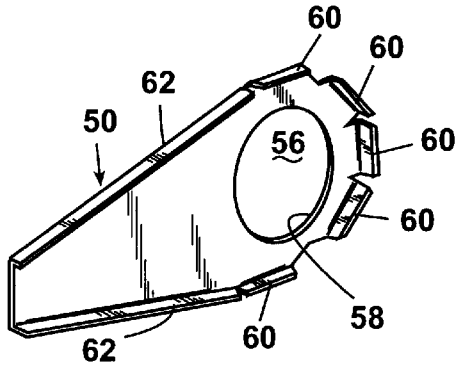
FIG. 4 is a perspective view of the front blank of FIG. 3 after tabs are formed from the blank.
Figure 5:
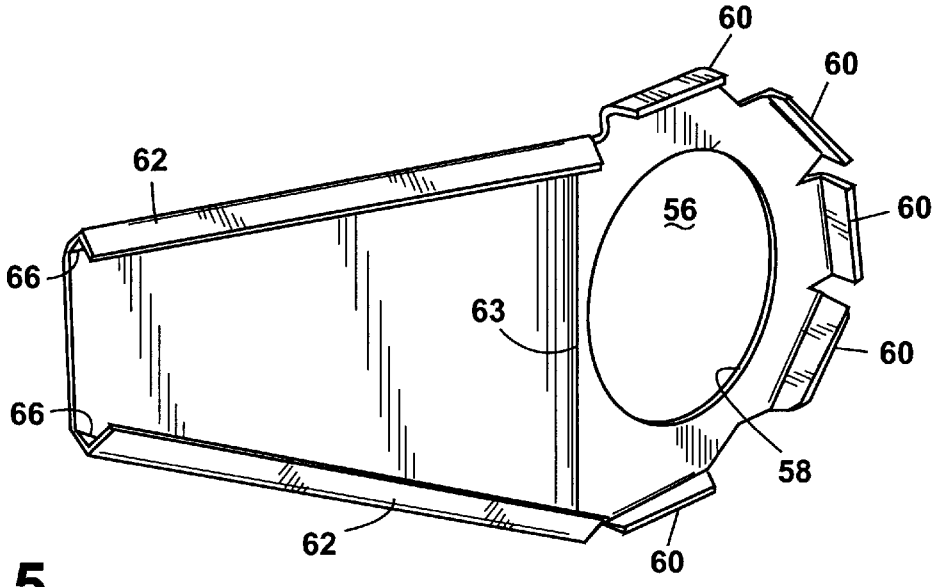
FIG. 5 is a perspective view of the front blank after it has been bent into its final shape prior to assembly with the bottom.

After the front is stamped, the tabs 60 and 62 are bent so they are generally perpendicular to the plane of the rounded portion 52 and tapered portion 54 (FIG. 4). The tapered portion is then bent angularly relative to the rounded portion at line 63. Additional bends 66 are provided on the tapered portion parallel and spaced from the tab 62, providing the tapered portion with somewhat of C-shaped cross-section (FIG. 5).

Figure 6:
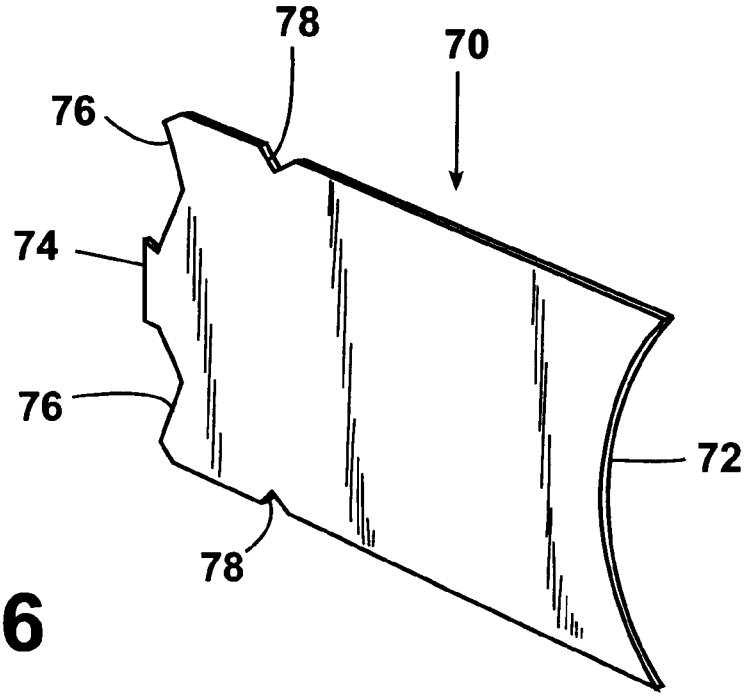
FIG. 6 is a perspective view of the rear blank for the dryer vent elbow of FIG. 1.
Figure 7:
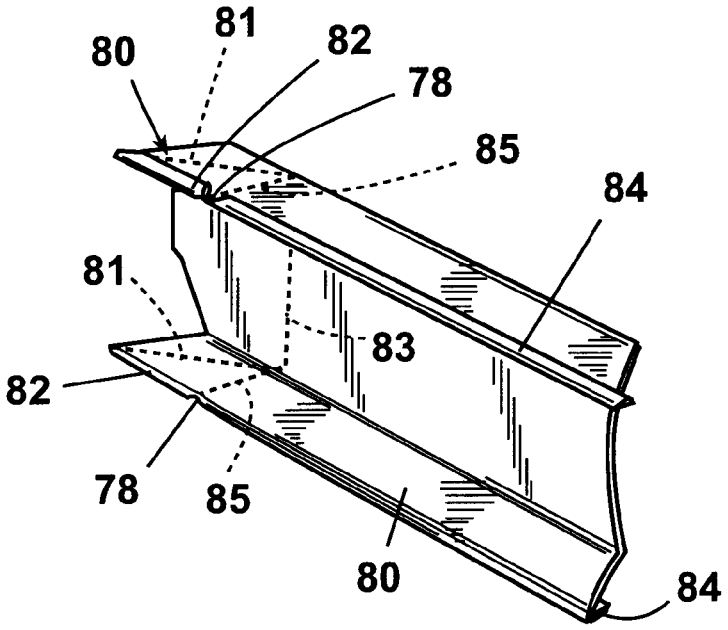
FIG. 7 is a perspective view of the rear blank after being roll formed to form sides and tabs.

Referring to FIG. 6, the rear 22 initially begins as a generally rectangular stamping 70. One end of the stamping 70 has an arcuate edge 72. The other end of the stamping 70 has a tab 74 from which extends V-shaped edges 76. Opposing notches 78 are provided in the sides of the stamping 70. The stamping 70 is then shaped, preferably by roll forming, to form side walls 80, folded along spaced parallel longitudinal fold lines beginning at the apex of the V-shaped edges, from which extend tabs 82 and 84, separated by the notches 78 (FIG. 7). Tabs 82 and 84 form the other portion of the interlocking tabs 24.

Figure 8:
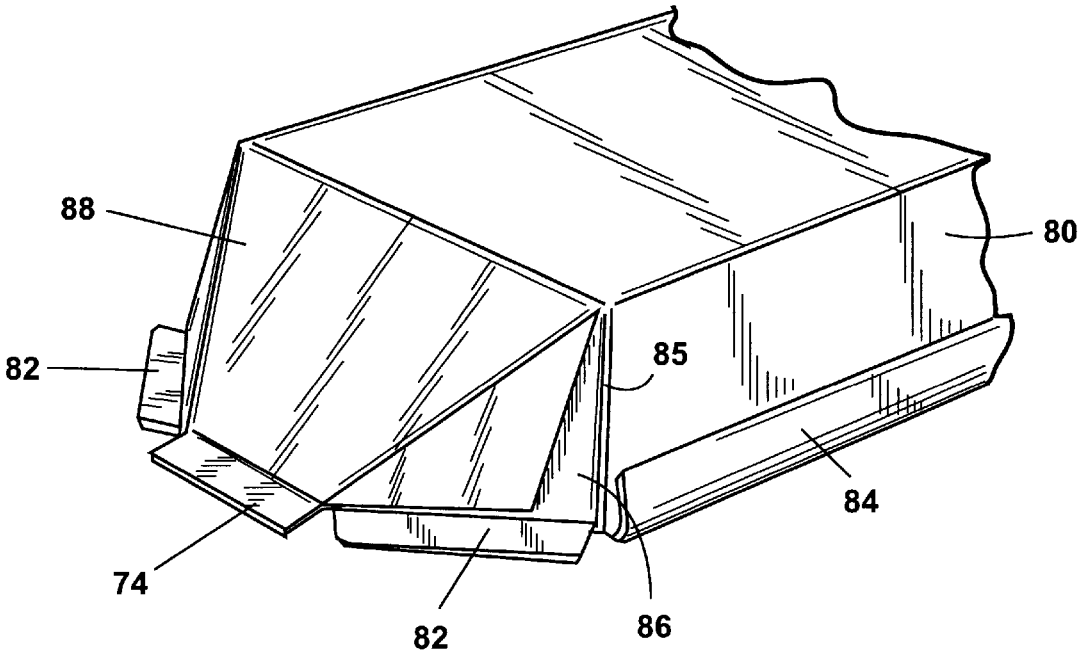
FIG. 8 is a perspective view of the rear blank with a portion of the front sides bent in and the bottom bent over the bent sides to form a deflection surface.

A portion of the side walls 80 extending from the apex of the V-shaped edges to the apex of the notches 78 is bent inwardly along lines 81 and 85. A portion of the bottom wall is then bent in at line 83, generally aligned with the notches 78, to form a ramp 88 (FIG. 8), which overlies the bent-in side portions 86. The sides of the ramp 88 are then bent over the side portions 86, completing the formation of the deflector 28 (FIG. 8).

After the formation of the deflector portion 28, the back stamping 70 is then bent along a transverse line 90 (FIG. 9) to form the upper end of this rectangular portion 30. The stamping 70 is bent in such a manner so that the portion of the side walls of the rectangular portion are received interiorly of the remaining side walls 85.

Figure 9:
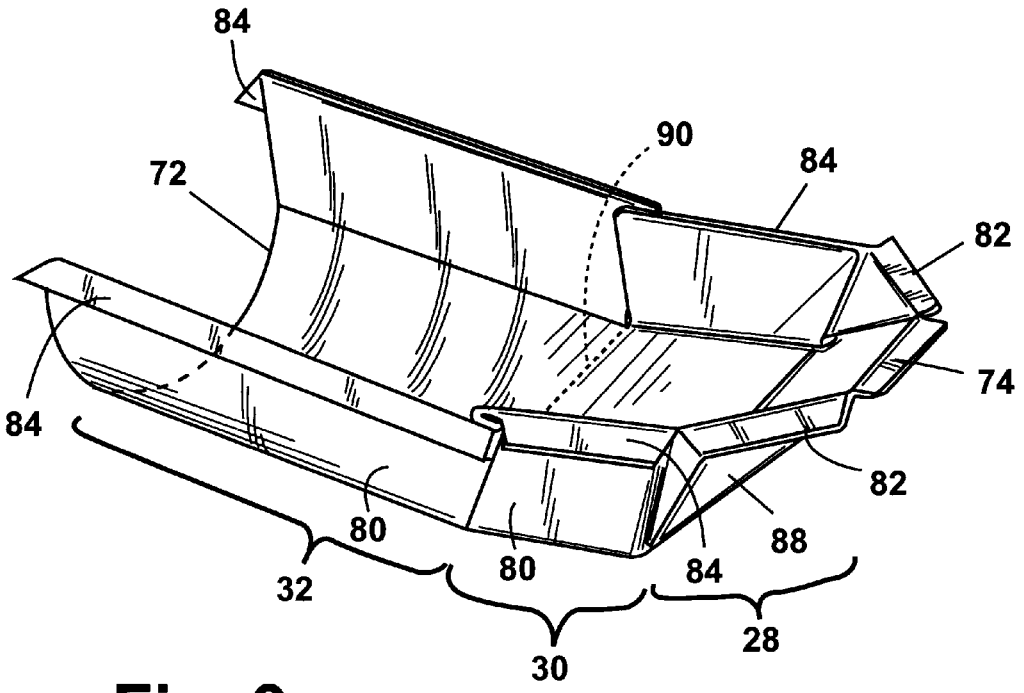
FIG. 9 is a perspective view of the rear blank in its final pre-assembly state with the front portion folded at an angle relative to the rear portion.

Referring to FIG. 9, to complete the formation of the transition portion 32, the bend lines separating the side walls from the bottom wall of the stamping 70 are smoothed out to form the transition portion, extending from the rectangular cross-section of the rectangular portion to the rounded cross-section of the outlet portion 14. Advantageously, the arc 72 is cut in such a manner so that when the edges are rounded, the arc 72 defines a partial circular cross-section that is complementary to the circular cross-section of the outlet portion 14.

Figure 10:
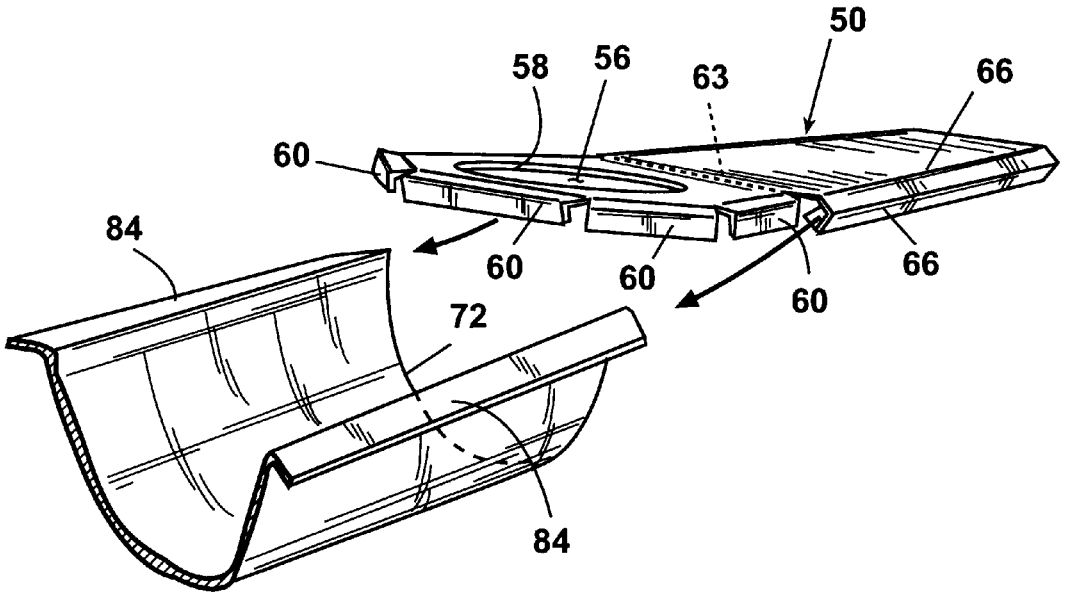
FIG. 10 is an assembly view of the front and rear blanks.
Figure 11:
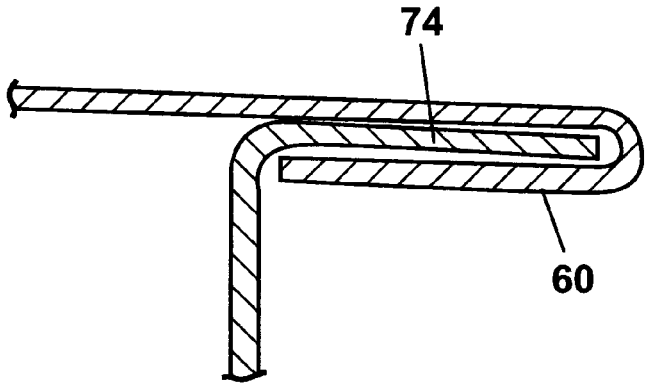
FIG. 11 is a sectional view taken along line 11—11 of FIG. 1 illustrating the first folding of the front and rear tabs.

Referring to FIG. 10, once the front 20 and rear 22 are properly shaped, the front 20 is mounted to the rear 22 by positioning the front so that the flanges 62 are aligned with the flanges 84. The front 20 is then snapped on or slid relative to the rear 22 so that the flanges 62 overlap the flanges 84 and the flanges 60 parallel the flaps 82.

Figure 12:
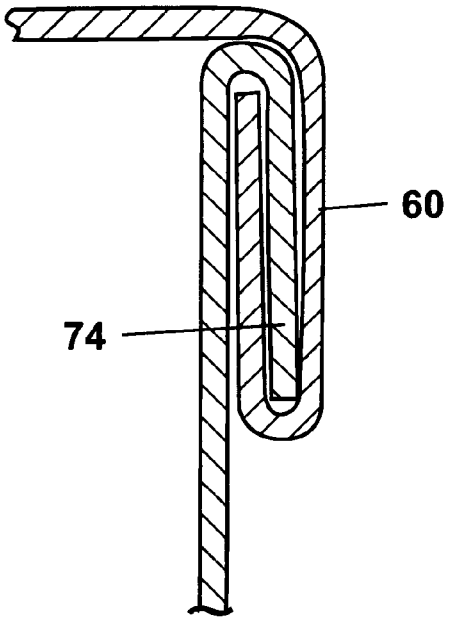
FIG. 12 is a sectional view taken along line 12—12 of FIG. 1 illustrating the second folding of the front and rear tabs.
Figure 13:
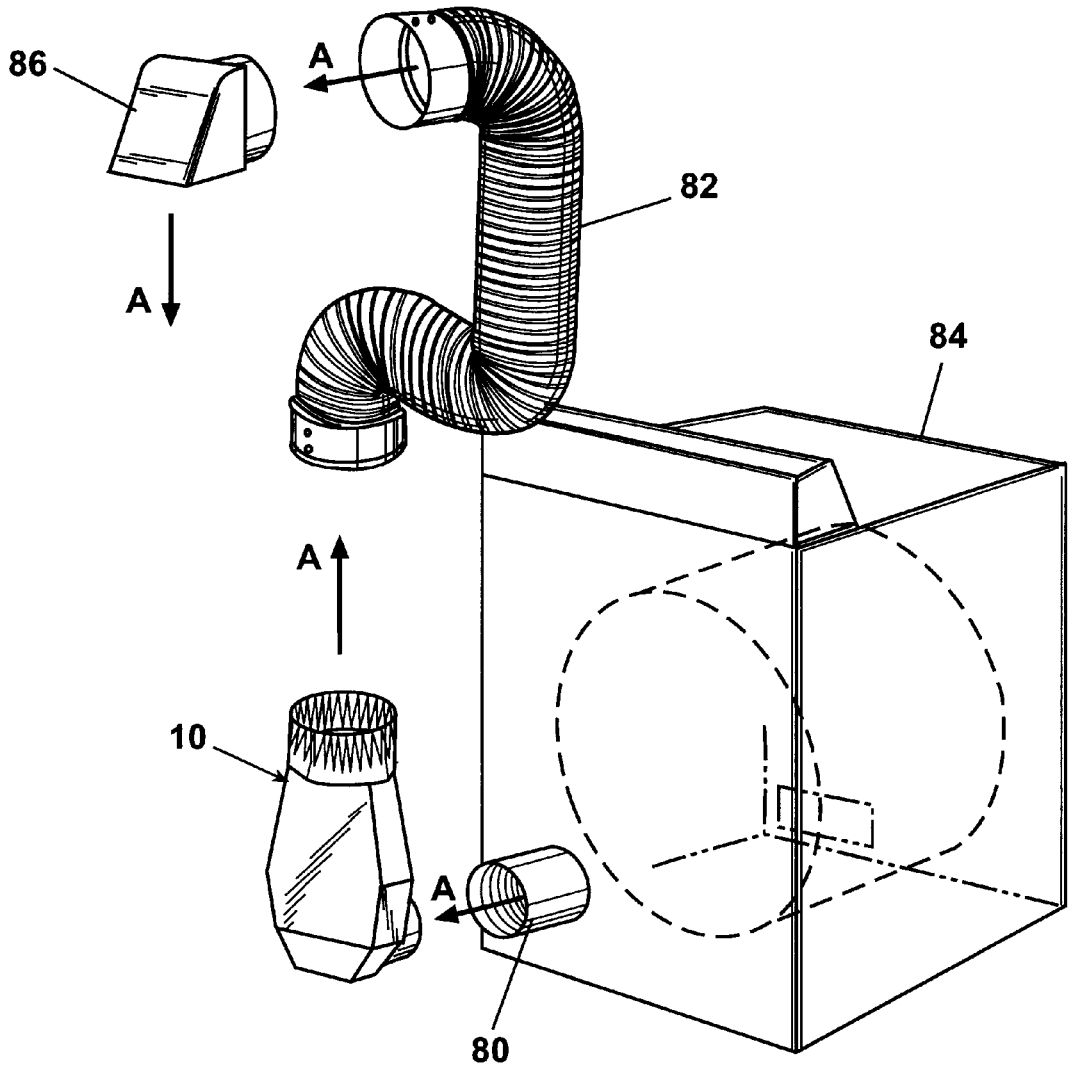
FIG. 13 is a perspective view of the dryer vent elbow according to the invention shown in the environment of a generic clothes dryer having a dryer exhaust vent coupled to an exhaust vent through an exhaust duct.

To fix the front 20 to the rear 22, the tabs 82 are then folded over the tabs 62 and the tabs 60 are folded over the tabs 82 and 74. Additionally, the folded tab pairs 60, 82 and 60, 74 are bent on a common line to fold them over on themselves to lock the front 20 to the rear 22 (FIGS. 12 and 13). If needed, rivets or other mechanical fasteners are used to secure the front 20 to the rear 22. The outlet portion 14 is then mounted to the end of the body 12 in a well known manner.

The elbow according to the invention has many advantages over prior art elbows. First, the total depth of the elbow is no greater than the diameter of the exhaust duct, thereby minimizing the distance that the dryer can be spaced from the wall. Second, the cross-sectional area of the elbow is generally constant throughout its length to maintain a constant airflow speed, reducing the likelihood that lint and other particles entrained in the airflow will fall out and deposit themselves within the elbow. Third, all of the edges created during the bending operations are downstream of the exhaust air and do not provide an edge face against which the airflow would impinge and particles in the airflow could collect. Fourth, the assembled body 12 is substantially sealed with respect to the atmosphere because the front and the back are formed from single pieces of material, which are connected together by the overlapping flaps, preventing openings through which atmospheric air could be drawn into the exhaust air flow.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention. For example, although the elbow is described in the preferred environment of connecting a dryer exhaust vent to an exhaust duct to reduce the distance the dryer is spaced from the wall, the elbow can also be placed within a wall and can connect the dryer exhaust vent to an exhaust duct within a wall. Another application is that the elbow can be placed within or outside of an exterior wall to connect the exhaust duct to a vent 86 exiting the exterior wall. There can also be multiple elbows used for a single dryer exhausting.

What is claimed is:

1. A dryer vent elbow for connecting a dryer exhaust vent to an exhaust duct having a predetermined diameter to control the flow path of dryer exhaust air exhausted by a clothes dryer, the dryer vent elbow comprising:

an inlet adapted to connect to the dryer exhaust vent;

an outlet adapted to connect to the exhaust duct; and a body having an inlet opening connected to the inlet and an outlet opening connected to the outlet, the body comprising:

a front having a lower portion comprising the inlet opening and an upper portion having an upper edge that partially defines the outlet opening; and a back connected to the front and having a lower portion with a back wall partially defining a rectangular cross section and an upper portion with a partial circular cross section, the upper portion having an upper edge that partially defines the outlet opening, wherein the body has a generally rectangular cross section defined by the front and back lower portions that transitions to a generally circular cross section defined by the front and back upper edges to form the outlet opening.

2. The dryer vent elbow according to claim 1 wherein the cross-sectional area within the body in any plane normal to the flow path is generally constant.

3. The dryer vent elbow according to claim 1 wherein the upper portion of the front and back taper from the lower portion to the upper edge of the front and back.

4. The dryer vent elbow according to claim 1 wherein the back lower portion includes a deflector comprising an angled wall extending upwardly away from the front lower portion and adapted to deflect dryer exhaust air from the inlet opening to the outlet opening.

5. The dryer vent elbow according to claim 1 wherein the front lower portion is generally planar and, in conjunction with the partial rectangular cross section of the back lower portion, defines a body rectangular portion.

6. The dryer vent elbow according to claim 5 wherein the upper portion of the front and back abut the lower portion of the front and back, respectively, to define a junction between the upper portion and lower portion of the front and back, and the upper portion of the front and back tapers from the junction to the upper edge of the front and back.

7. The dryer vent elbow according to claim 6 wherein the body has a generally rectangular cross section at the junction and a generally circular cross section at the upper edges of the front and back to define a body transition portion having a cross section that transitions from a rectangular cross section to a circular cross section.

8. The dryer vent elbow according to claim 7 wherein the back lower portion includes an angled wall extending upwardly away from the front lower portion to define a body deflector portion separated from the body transition portion by the body rectangular portion.

9. The dryer vent elbow according to claim 1 wherein each of the front and back have at least one peripheral complementary tab, one of the front and back complementary tabs being folded over the other of the front and back complementary tabs to connect the front to the back.

10. The dryer vent elbow according to claim 9 wherein both the front and back complementary tabs are folded along a common line.

11. The dryer vent elbow according to claim 1 wherein the inlet is rotatably mounted to the body.

12. The dryer vent elbow according to claim 11 wherein the outlet is rotatably mounted to the body.

13. The dryer vent elbow according to claim 1 wherein the lower portion is generally orthogonal to the inlet and the upper portion extends over the inlet.

14. A method of manufacturing a dryer vent elbow comprising:

an inlet, an outlet, and a body having an inlet opening connected to the inlet and an outlet opening connected to the outlet, the body comprising:

a front having a lower portion comprising the inlet opening and an upper portion having an upper edge that partially defines the outlet opening; and a back connected to the front and having a lower portion with a back wall partially defining a rectangular cross section and an upper portion with a partial circular cross section, the upper portion having an upper edge that partially defines the outlet opening, wherein the body has a generally rectangular cross section defined by the front and back lower portions that transitions to a generally circular cross section defined by the front and back upper edges to form the outlet opening, the method comprising:

forming a blank for the back with an arcuate end that forms the upper edge of the rear;

forming a blank for the front with an opening and an upper edge;

connecting the front and back blanks to assemble the body, with the front blank opening forming the inlet opening and the arcuate end and upper edge forming the outlet opening;

providing an inlet and an outlet;

connecting the inlet to the inlet opening; and connecting the outlet to the outlet opening.

15. The method of claim 14 wherein the forming of the front and back blanks includes stamping the blanks from galvanized metal.

16. The method of claim 15, and further comprising bending the edges of the front and back blanks to form complementary tabs and bending one of the complementary tabs over the other of the complementary tabs to connect the front blank to the back blank.

17. The method of claim 16, and further comprising bending the complementary tabs about a common bend line.

18. The method of claim 14, and further comprising bending the back blank about two spaced parallel longitudinal bend lines to form parallel side walls connected by a generally planar portion to provide the back blank with a partial rectangular cross section.

19. The method of claim 18, and further comprising bending the back blank about a first transverse bend line below the arcuate end such that the portion of the side walls and planar portion between the bend line and the arcuate end forms an arcuate angle relative to the planar portion and side walls of the blank below the bend line.

20. The method of claim 19 wherein the bending of the back blank about a first transverse bend line includes bending the side walls such that the portion of the side walls below the bend line is received interiorly of the portion of the side walls above the bend line.

21. The method of claim 19, and further comprising shaping the portion of the back blank between the first transverse bend line and the arcuate end to form a transition portion that transitions from a partial rectangular cross section at the bend line to a partial circular cross section at the arcuate end, which defines the back blank upper edge.

22. The method of claim 21 wherein the shaping of back blank includes tapering the back blank from the first transverse bend line to the arcuate edge.

23. The method of claim 22 wherein the shaping of the back blank further includes smoothing out the parallel longitudinal bend lines between the first transverse bend line and the arcuate edge.

24. The method of claim 21, and further comprising forming a deflector portion by bending the back blank about a second transverse bend line below the first transverse bend line to form an angled wall that is adapted to at least partially extend into the exhaust air flow path through the inlet opening to deflect exhaust air to the outlet opening when the back blank is mounted to the front blank.

25. The method of claim 24, wherein the forming of the deflector portion includes bending the side walls such that the portion of the side walls below the bend line is received interiorly of the portion of the side walls above the bend line.

26. The method of claim 24, and further comprising the step of forming the front blank with a generally semi-circular portion in which is located the inlet opening and a tapered portion having an upper edge.

27. The method of claim 26, and further comprising bending the front blank about a third transverse bend line at the junction of the semi-circular portion and the tapered portion.

28. The method of claim 27 wherein the step of connecting the front and back blanks includes aligning the generally semi-circular portion with the deflector portion and the partial rectangular portion and the transition portion with the tapered portion.

29. The method of claim 28, and further comprising bending the edges of the front and back blanks to form complementary tabs and bending one of the complementary tabs over the other of the complementary tabs to connect the front blank to the back blank.

30. The method of claim 29, and further bending the complementary tabs about a common bend line.

31. The dryer vent elbow according to claim 1 wherein the inlet is spaced from the back wall a distance less than or equal to the exhaust duct diameter.

* * * * *